US005735070A

United States Patent [19]

Vasquez et al.

[11] Patent Number: 5,735,070

[45] Date of Patent: Apr. 7, 1998

[54] ILLUMINATED GUN SIGHT AND LOW AMMUNITION WARNING ASSEMBLY FOR FIREARMS

[76] Inventors: Eduardo C. Vasquez, 3710 NW. S. River Dr., Miami, Fla. 33142; Michael S. Critchley, 354 NE. 126 St., Miami, Fla. 33161

[21] Appl. No.: 621,733

[22] Filed: Mar. 21, 1996

[51] Int. Cl.[6] ..... F41A 9/62; F41G 1/34

[52] U.S. Cl. ..... 42/1.02; 42/103; 33/241

[58] Field of Search ..... 42/1.01, 1.02, 42/103; 33/241

[56] References Cited

U.S. PATENT DOCUMENTS

| | | | |
|---|---|---|---|
| 3,698,092 | 10/1972 | Rosenhan | 33/241 |
| 3,833,799 | 9/1974 | Audet | 42/1.02 |
| 3,914,873 | 10/1975 | Elliott, Jr. et al. | 33/241 |
| 4,219,953 | 9/1980 | Musgrave | 42/1.02 |
| 4,434,560 | 3/1984 | Comeyne | 33/241 |
| 5,142,805 | 9/1992 | Horne et al. | 42/102 |

*Primary Examiner*—J. Woodrow Eldred

[57] ABSTRACT

An assembly for use on weapons includes an illuminated gun sight system to permit the user to aim and shoot the weapon in varying ambient light conditions and including a first light emitting element on a front sight and a second pair of light emitting elements on a rear sight of the firearm, a light generating source to provide light to the first light emitting element and the second pair of light emitting elements; the first and second light emitting elements including a light modifying element to produce a distinct luminous reference shape of uniform light intensity throughout a visible light radiating area. A servo system sensor is responsive to ambient light conditions for adjusting the intensity of light radiating from the light emitting elements so that the intensity of light radiating from the light emitting elements increases and decreases in direct relation to changes in ambient light conditions. A low ammunition warning system includes a detector and a circuit for tracking depletion of ammunition contained in the weapon. Visible and tactile signals, responsive to the circuit, warn the user when a known pre-set low ammunition count has been reached.

55 Claims, 12 Drawing Sheets

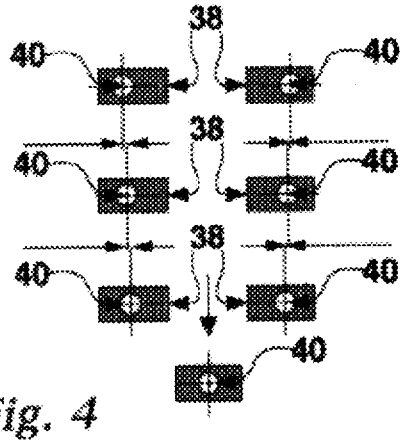
Fig. 4
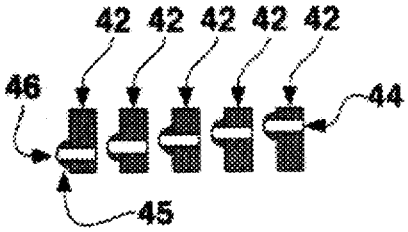
Fig. 5
Fig. 4a
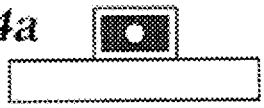
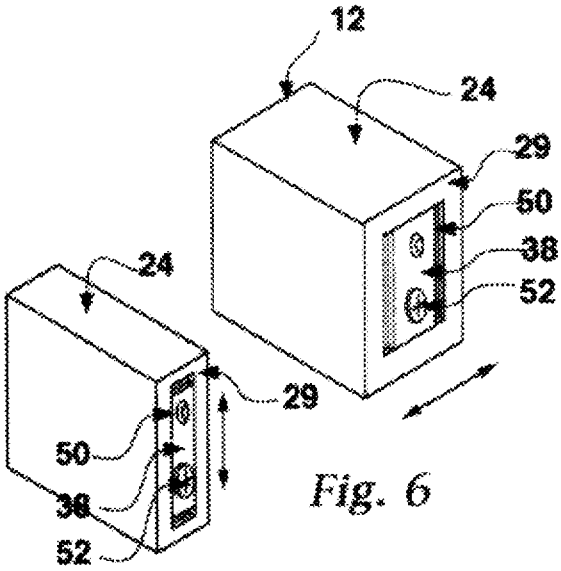
Fig. 6
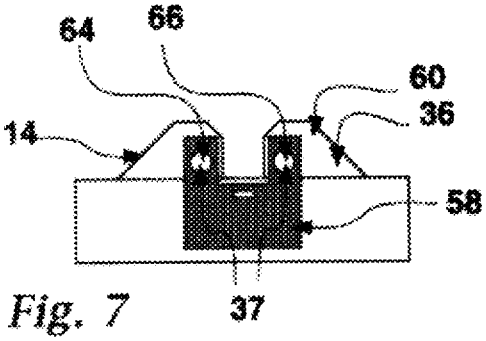
Fig. 7
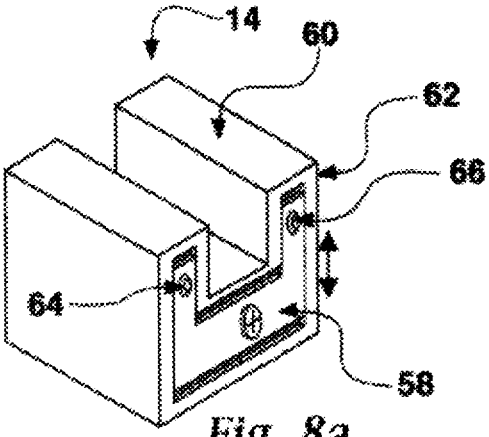
Fig. 8a
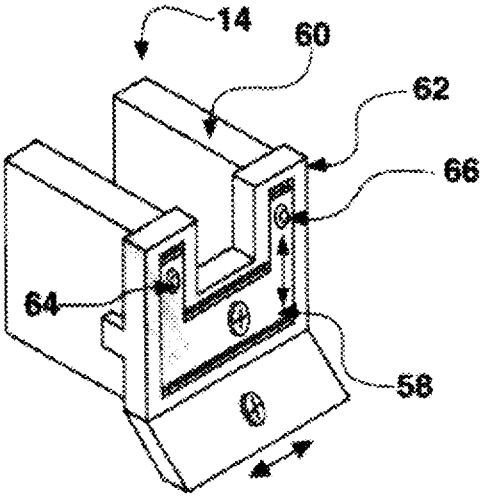
Fig. 8b

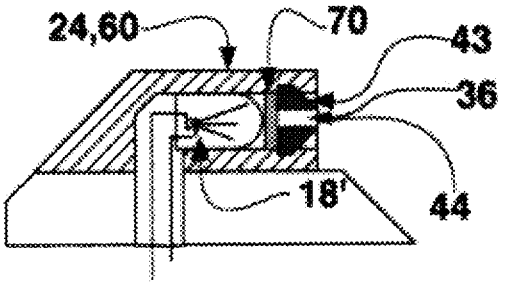
Fig. 9a
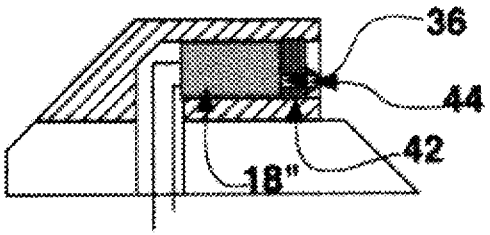
Fig. 9b
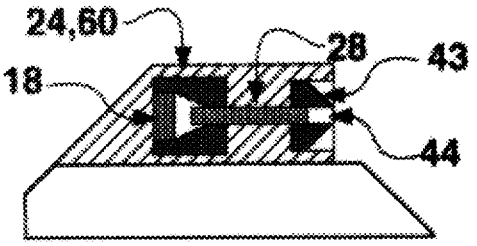
Fig. 10a
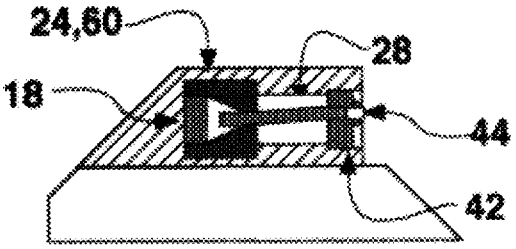
Fig. 10b
Fig. 11
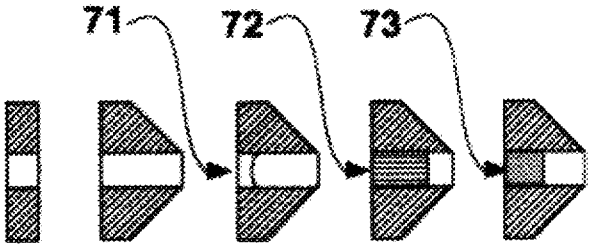
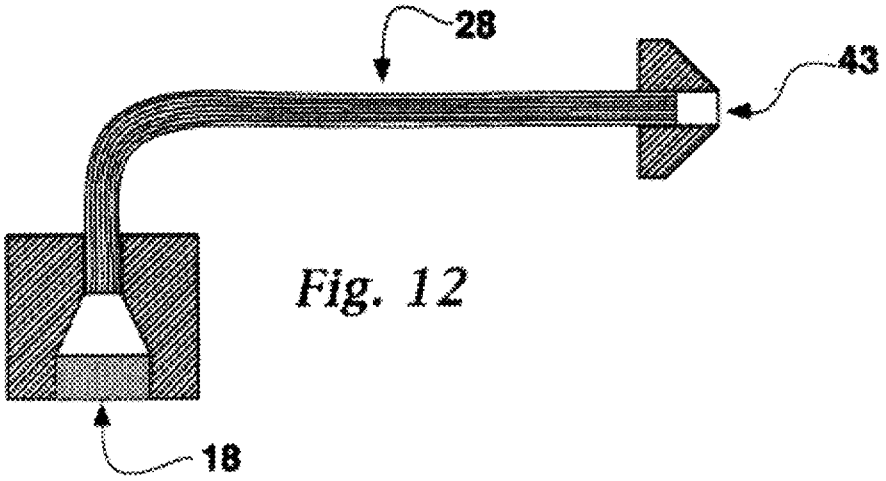
Fig. 12

ILLUMINATED GUN SIGHT AND LOW AMMUNITION WARNING ASSEMBLY FOR FIREARMS

BACKGROUND OF THE INVENTION

1. Field of the Invention

The present invention relates to an assembly for use on a firearm and, more particularly, to an illuminated gun sight system and low ammunition warning system to assist with aiming and shooting a firearm in varying ambient light conditions.

2. Discussion of the Related Art

It is well understood by law enforcement, armed forces and security personnel that, under life threatening situations, a fraction of a second can mean the difference between life or death. Under such impending circumstances, wherein ambient light conditions may vary from very bright to complete darkness, an improved aiming device that allows for quicker and more accurate aiming of a weapon becomes an obvious advantage. Furthermore, under such circumstances, should a prolonged confrontation arise, a means of forewarning the user of a firearm that the ammunition load in the firearm is low is of great benefit.

Prior to firing a weapon, it is, of course, of primary importance to aim the weapon at the intended target. The conventional manner of aiming a firearm involves aligning the front and rear gun sight elements with the intended target along the user's line of sight. Regardless of design, this procedure requires constant visual inspection between the profile of the sight elements and the target in order to acknowledge proper gun sight alignment. This is difficult for most people because human vision cannot focus sharply at the same time on both a close-up subject, such as the conventional gun sight elements on a firearm, and a distant object, such as a target. Accordingly, the visual inspection procedure required in order to correctly aim with conventional type gun sights requires constant change of the visual focus range by the eye of the user between the gun sights and the distant target. In a critical situation, the execution of such a procedure inevitably results in lost time and a subsequent impaired response; a problem that becomes compounded even further under varying and/or low ambient light conditions.

Considering the foregoing, it is desirable to have a gun sight that does not require visual focusing on both the gun sight and distant target. More specifically, it is desirous to provide a gun sight that allows the user of a firearm to maintain a focus on a distant target which, at the same time, supplies enough visual reference to the user in order to ensure that the front and rear sights are properly aligned so that the firearm is aimed accurately at the target.

A further concern which many law enforcement, armed forces and security personnel encounter during a prolonged confrontation is the inability to determine when the load of ammunition in the firearm is running low. In a very intense, hostile confrontation, many rounds of ammunition can be quickly expended. The intensity of such situations makes it difficult, if not impossible, for the user of a firearm to keep track of the amount of ammunition remaining in his/her firearm.

There is, therefore, an urgent need for an effective means for indicating a low ammunition condition to the user of a firearm.

In the past, various battery operated luminous sights and ammunition monitoring devices have been presented in an effort to provide a solution to the above described problems in the art. However, the proposed solutions are bulky, heavy and require advanced and/or expensive adaptations to be made to a firearm in order to retrofit the device on the firearm. Some of the luminous sights proposed in the related art involve the use of LED lamps as light sources which aim toward the eye of the user. These proposed luminous sights utilize bare LED lamps without any means of modification of the quality of light which is radiated toward and viewed by the user. The excessive amount of glare produced by these types of light sources make them extremely difficult to view and can be distracting and/or irritating.

The problem associated with the use of a bare LED lamp is a result of the structural configuration of such light sources. LED lamps include a cathode, an anode and a semiconductor crystal chip which are interconnected to produce a light emitting diode. This diode is further encapsulated to form an LED lamp. By circulating a current flow through the crystal, a point source of a sharp cutting monochromatic light is generated. The impurities induced in the crystal's structure at the time of its manufacture determine the wavelength of the emitted light. In the most common designs of LED lamps, one of the metal conductors is intended act, in addition to a power conductor, as a rear reflector portion which focuses the sharp monochromatic light in a definite direction.

Examples of use of LED lamps in illuminated sights can be found in various references in the related art such as U.S. Pat. No. 3,833,799 to Audet. The patent to Audet discloses an illuminated gun sight system which uses an LED lamp as an isolated frontal sight element in a supplemental installation on a conventional front gun sight of a firearm. This illuminated frontal sight is intended to be viewed by the user as a pinpoint of light through a rear conventional iron sight.

Use of a bare LED lamp on a gun sight, without modification of the light emitted therefrom, presents a problem of inaccuracy. This is because the physical center of the LED lamp does not coincide exactly with the physical location of the illuminating crystal embedded within the lamp. This problem becomes clearly apparent when the light intensity of the LED lamp is adjusted at a lower intensity level wherein flare is substantially reduced. The center of the pinpoint light created by the illuminating crystal will vary from one LED lamp to another. It is thus apparent that, when lowering the LED lamp intensity, accuracy will be lost since the visual reference (the pinpoint of light) will shift within the lamp depending upon the location of the illuminating crystal therein. Accordingly, the pinpoint of light inside the LED lamp is of uncertain location due to structural inconsistencies inherent in the manner in which these devices are manufactured. Thus, the light center is severely out of alignment in relation to the external housing of the lamp, not only by design, but also due to the fact that the exact location and angular orientation of the light emitting crystal is impossible to be controlled at the time of manufacture. These inherent characteristics of LED lamps present a problem of inconsistency and inaccuracy.

An improvement to the use of a bare, openly exposed light source on an illuminated gun sight system is disclosed in the patents to Agnello, U.S. Pat. No. 3,994,072 and Betz, U.S. Pat. Nos. 5,279,061 and 5,373,657. In each of these references, an LED lamp is located within a recessed portion of a front gun sight element, providing some light scatter control and improving upon the system disclosed in the Audet patent. However, these systems, as disclosed in Agnello and Betz are limited in practical application to the foremost tip of a long barrel weapon, such as a rifle, wherein the light element becomes visually scaled down in order to substantially minimize the impact that the inconsistencies of LED lamps have on accuracy. A further problem associated with the above illuminated gun sight systems is that they produce flare, even though recessing of the LED lamp within the gun sight housing segregates the most widely diverging portion of the light emitted by the LED lamp. It is further noted that the LED lamps shown in these references present a frontal curved lens which will further contribute to the divergence of emitted light. Also, the visible portion of the light that reached the user's eye will be still be poignant in nature.

SUMMARY OF THE INVENTION

The present invention is directed to an assembly for use on a firearm and, specifically an illuminated gun sight system to facilitate accurate aiming of a gun in all ambient light conditions and a low ammo warning system to indicate that the load of ammunition in a firearm has reached a predetermined low ammo count.

The assembly of the present invention includes a front sight which is fixed on the distal end zone of the barrel of a firearm, and a rear sight fixed on the proximal end zone of the firearm's barrel. A light emitting means on the front and rear sights is structured to radiate light in a direction towards the proximal end of the firearm in substantially parallel relation to a central longitudinal axis of the barrel. At least one light generating source provides light to the light emitting means at the front and rear sights upon application of electric current thereto. Light modifying means is further provided to produce a distinct luminous reference shape of uniform light intensity throughout a visible light radiating area of each of the light emitting means on the front and rear sights.

A low ammo warning system includes an event detecting means for tracking depletion of ammunition from a load of ammunition contained in the firearm. The low ammo warning system further includes signal means which is responsive to the event tracking means and includes both visible and tactile indicators for indicating that the ammunition remaining in the load has reached a predetermined low ammo count.

A servo system sensor is responsive to ambient light conditions for adjusting the intensity of light radiating from the light emitting means, so that the light intensity of visible light radiating from the light emitting means increases as the intensity of ambient light conditions increases and, alternatively, so that the light intensity of visible light radiating from the light emitting means decreases as the intensity of the ambient light conditions decreases.

The assembly further includes means for providing electric current to the light generating source, the low ammunition warning system, the low ammo warning signal means and the light adjusting means. Power conservation means includes on/off pulsating of powers through the electric current providing means as well as circuitry structured to extend the useful life of the power source until most of the entire power source is depleted, compensating to some extent for the gradual power decline typical toward the end portion of a electric power storage device. A low power warning signal is further provided to indicate to the user that the electric power storage source is running low.

With the foregoing in mind, it is a primary object of the present invention to provide an assembly for use on a firearm to facilitate accurate aiming of the firearm in all light conditions, ranging from extremely bright ambient light conditions to complete darkness.

It is another object of the present invention to provide an assembly for use on a firearm for monitoring the firearm's activity and signaling to the user when a known preset low ammo count has been reached.

It is still a further object of the present invention to provide a gun sight system which includes a set of front and rear luminous elements on the front and rear gun sights which are structured to be visible using peripheral vision while aiming a firearm and focusing on a distant target.

It is yet a further object of the present invention to provide luminous elements of the front and rear gun sights of a firearm which include means to modify light radiating from the luminous elements so as to produce a distinct luminous reference shape of uniform light intensity throughout an entire visible light radiating area of the elements.

It is still a further object of the present invention to provide an assembly for use on a firearm including luminous elements on the front and rear gun sights of the firearm and a low ammunition warning system, wherein the entire assembly is compact, streamlined and does not substantially alter the size, shape and weight of the firearm.

It is yet a further object of the present invention to provide an assembly for use on a firearm including luminous elements of the front and rear gun sights of the firearm and a low ammunition warning system which monitors weapon mechanism activity and discharge of ammunition and signals a low ammunition count, wherein the entire assembly is powered by a low voltage, light weight battery source contained within the firearm.

It is still a further object of the present invention to provide a luminous gun sight system and low ammunition warning system powered by a low voltage electric current and further including means to conserve consumption of electric power.

These and other objects and advantages of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which:

FIG. 4 illustrates a plurality of mask plates for use on the front sight assembly;

FIG. 4A is a front elevational view of the front illuminated sight assembly with a mask plate thereon to produce a distinct luminous reference shape;

FIG. 5 is a side sectional view of a plurality of replaceable inserts for use on the front sight assembly;

FIG. 6 is an exploded view illustrating another embodiment of masks on the front sight assembly, illustrating both vertical and transverse adjustment thereof;

FIG. 7 is a front elevational view of the rear illuminated sight assembly in accordance with one preferred embodiment of the present invention;

FIG. 8A is a perspective diagrammatic view illustrating vertical adjustment of a masking plate on the rear sight assembly;

FIG. 8B is a perspective view illustrating an alternative embodiment of the rear sight assembly to facilitate both vertical adjustment and transverse adjustment of the masking plates and, accordingly, the position of the light reference shapes thereon;

FIG. 9A is a side elevation, in partial section, illustrating one embodiment of the front sight assembly wherein an LED lamp or like light emitting source is used in conjunction with a light diffusion screen and a hood type insert;

FIG. 9B is a side elevation, in partial section, illustrating another embodiment of the front sight assembly using an LED lamp or like light emitting source used in conjunction with light diffusion screen and an insert of the type shown in FIG. 5;

FIG. 10A is a side elevation, in partial section, illustrating another embodiment of the front sight assembly including a light source, a fiber optic light transmitting means, and a hood type insert;

FIG. 10B is yet another embodiment of the front sight assembly including a light source, a fiber optic light transmitting means and an insert of the type shown in FIG. 5;

FIG. 11 is a side elevation, in partial section, illustrating a plurality of inserts for use with the front or rear sight assemblies;

FIG. 12 is a side elevation, in partial section, illustrating a light source within a light box assembly and a fiber optic light transmitting means extending between the light box assembly and insert of the type shown in FIG. 11 for transmitting light remotely from the light source to an exposed aperture of the sight;

Like reference numerals refer to like parts throughout the several views of the drawings.

DETAILED DESCRIPTION OF THE PREFERRED EMBODIMENTS

Referring to the several views of the drawings, and initially

FIGS. 1–8B, there is illustrated the illuminated gun sight assembly of the present invention in accordance with preferred embodiments thereof.

Figure 1:
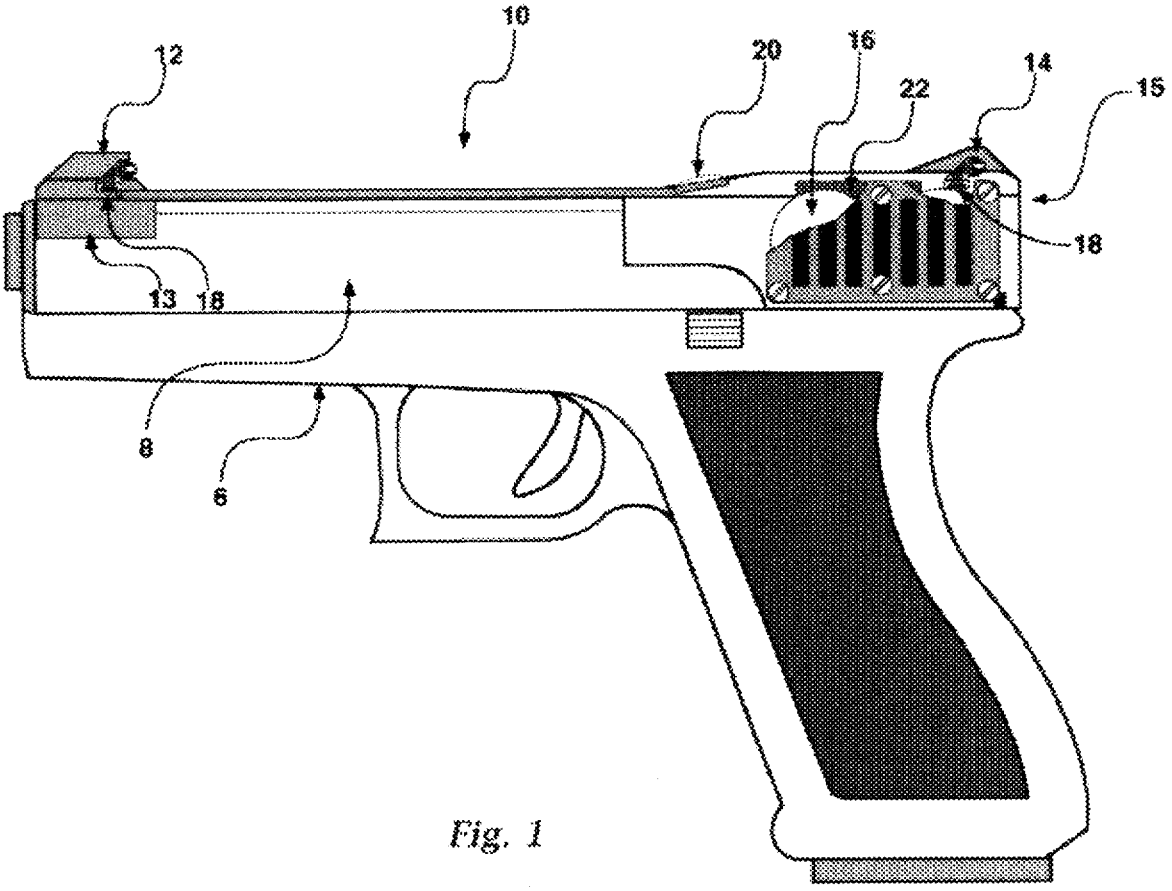
FIG. 1 is a side elevational view of a first embodiment of the illuminated gun sight assembly in accordance with the present invention.

Referring to FIG. 1, the illuminated gun sight assembly, generally indicated as 10, includes a front illuminated sight assembly 12 installed on the top of the distal end zone 13 of the barrel or slide 8 of a hand gun 6, and a rear illuminated sight assembly 14 installed on the top rear end 15 of the hand gun 6, in accordance with the conventional positioning of front and rear sights on a hand gun.

The front and rear illuminated sight assemblies 12, 14 are specifically structured to emit distinct luminous reference shapes throughout a visible light radiating area. A power source, such as a battery 16, provides electric power to a light emitting source 18 of the front and rear sight assemblies. A servo system sensor 20 is responsive to ambient light conditions for adjusting the intensity of light radiating from the front and rear luminous sight assemblies and is interconnected with an electronic circuit device 22 for controlling and regulating power to the light emitting source 18 at both the front and rear light assemblies, as well as controlling operation of all component elements of the assembly 10.

Figure 2:
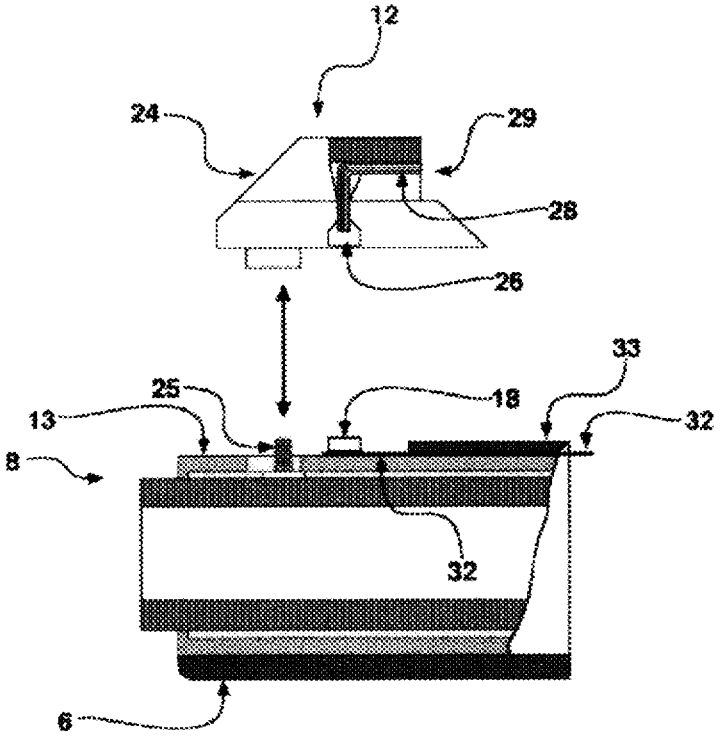
FIG. 2 is an isolated side elevational view, in partial section, illustrating a front luminous sight assembly in accordance with one embodiment of the present invention.

FIG. 2 shows a detailed view of the front luminous sight assembly 12 including a housing 24 which is removably fitted to the top distal end zone 13 of the gun barrel or slide 8 with a conventional threaded fastener 25. The housing 24 includes a cavity 26 formed in a lower end which is sized and configured for receipt of the light emitting source 18 therein when the housing is attached to the gun. In this particular embodiment, a fiber optic strand 28 or like light transmitting element is fitted within the housing and extends from the cavity 26 to a front face 29 of the housing. An electrical conductor 32 extends along the top of the gun barrel from the power source 16 to the light emitting source 18. A cover 33 structured and configured for engagement on the top of the gun barrel may be provided to cover the conductor 32 to protect it from damage. With the housing 24 properly fitted to the distal end zone 13 of the gun barrel or slide 8, the front face 29 of the housing 24 is directed towards the rear end of the weapon. Light emitted from the light source 18 is transmitted through the fiber optic element 28 and is emitted from the front face 29 of the housing 24. In this particular instance, the fiber optic element 28 or like light transmitting element acts to modify the light emitted from the light source 18 so that the light emitted from the front face 29 of the housing is of a uniform intensity throughout a visible light radiating area 36. In order to further improve the luminous reference shape, mask and/or hood means may be provided on the front face of the housing, such as those shown in FIGS. 4, 5 and 11.

Figure 3:
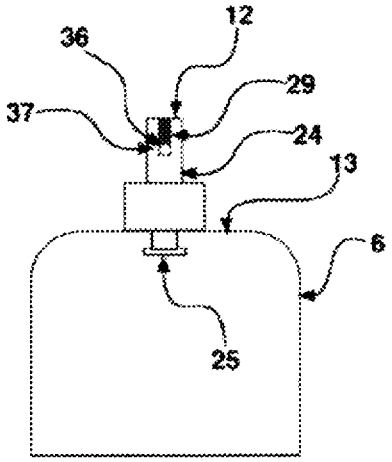
FIG. 3 is a front elevation of the front illuminated sight assembly.

Referring to FIG. 4, a plurality of masking plates 38 are shown which generally comprise a flat plate having an aperture 40 formed therethrough at a specific location on the plate 38. With the masking plate 38 fitted to the front face 29 of the luminous sight housing, the light emitted from the fiber optic element 28, or other light transmitting element, is visible through the aperture 40 as a distinct reference shape 37, such as a circle as seen in FIG. 3.

Referring to FIG. 5, a plurality of replaceable inserts 42 are shown, each having a light passage 44 formed therethrough at various predetermined heights along the insert. Each of the inserts 42 is provided with a hood cap member 45 surrounding an aperture 46 at the end of the light passage 44 to produce the distinct luminous reference shape 37 at a specific location on the front face 29 of the luminous sight housing.

Referring to FIG. 6, various embodiments of an adjustment means 50 for the front sight housing 24 are shown wherein the masking plates 38 of FIG. 4, or inserts 42 of FIG. 5, are secured to the front face 29 of the luminous sight housing with a screw 52 or like fastener. Loosening of the screw will permit vertical and/or transverse adjustment of the masking plate or insert to a fixed, adjusted position. Once in the desired position, tightening of the screw will maintain the masking plate or insert in the proper position. Accordingly, the specific location of the luminous reference shape 37 on the front face of the gun sight housing can be adjusted.

Referring to FIGS. 7–8B, the rear luminous sight assembly 14 is shown in general diagrammatic form and, in accordance with one preferred embodiment, includes a generally U-shaped masking plate 58 which mounts to the rearward directed face of the gun sight housing and is adjustable thereon, as seen in FIGS. 8A and 8B. The U-shaped masking plate 58 includes a pair of opposite apertures 64, 66 which create the distinct luminous reference shape 37. This may include that of the type shown in FIG. 2, wherein light is directed from a light source 18, through a fiber optic element 28 to the rearward directed front face of the gun sight housings. It should be noted at this point, that other light generating and transmitting means may be used, including one or more LED lamps as a light emitting source 18; the LED lamps being of opalescent encapsulation or of clear encapsulation with a light diffusion screen 70 or insert structured to modify light emitted from the light source to produce a uniform light intensity throughout an entire visible light radiating area 36.

In the embodiment of FIGS. 7–8B, wherein a masking plate 58 is used to create the distinct luminous reference shape 37, the rearward directed face 62 of the gun sight housing may be structured to slidably receive the masking plate 58 therein, in order to permit vertical and/or transverse adjustment of the masking plate and, accordingly, the apertures 64, 66 formed therein. This permits adjustment of the location of the luminous reference shapes 37 on the rear gun sight 14. Further, the rearward directed face 62 of the gun sight housing 60, to which the masking plate 48 is adjustably fitted, may also be adjustable relative to the gun 6 and/or a remainder of the gun sight housing to thereby permit lateral adjustment, as seen in FIG. 8B. In this manner, both the front luminous reference shape 37 on the front sight 12 and the rear luminous reference shapes 37 on the rear sight 14 can be adjusted to accommodate for variances in different hand guns which might otherwise effect the accuracy.

Referring to FIGS. 9A and 9B, there is illustrated another embodiment of the luminous sight housing 24 or 60, which may be used for both the front sight assembly 12 and the rear sight assembly 14. FIG. 9A shows a light emitting source 18', such as an LED lamp, which directs light onto a light diffusion screen 70 in the housing. The light diffusion screen is structured to modify light emitted from the light source 18' so as to produce a uniform light intensity throughout the entire light emitting area 36 on an opposite side of the diffusion screen. FIG. 9A shows a hood-type insert 43 which is fitted to the rearward facing side of the gun sight housing, in adjacent relation to the light diffusion screen 70. FIG. 9B shows an alternative embodiment using an insert 42, of the type previously described with reference to FIG. 5, and a light source 18" which is an opalescent encapsulated LED lamp. In either instance, radiating light passes through the light passage 44 of the insert 42, 43 to produce a distinct luminous reference shape.

FIGS. 10A and 10B illustrate another embodiment of the light source and light modifying means, wherein a light source 18 within the gun sight housing 24, 60 directs light through a fiber optic element 28, or like light transmitting element, to the insert 42, 43 on the rearward directed face of the gun sight housing.

In FIG. 11, various embodiments of masking means are shown, some of which include hoods 43, and others including inserts 42, including a diffusion insert 73, a concave lens insert 71, or a fiber optic insert 72, all of which are intended to produce a distinct luminous reference shape 37 of uniform light intensity throughout an entire visible light radiating area 36 on the rearward directed face 29, 62 of the gun sight assemblies 12, 14 (both the front and rear sight assemblies).

FIG. 12 illustrates another embodiment, which is essentially consistent with that shown in FIGS. 10A and 10B, wherein a fiber optic element 28 or light transmitting element interconnects between a mask 38, hood 43, or insert 42 on the gun sight to direct and modify the light so as to produce the distinct luminous reference shape 37 in accordance with the desired effect of the present invention, allowing also to locate the light source 18 remotely by utilizing an extended fiber optic light guide 28.

Referring now to FIGS. 13–20B, there is illustrated various embodiments of the low ammunition warning assembly 80 in accordance with the present invention.

Figure 13:
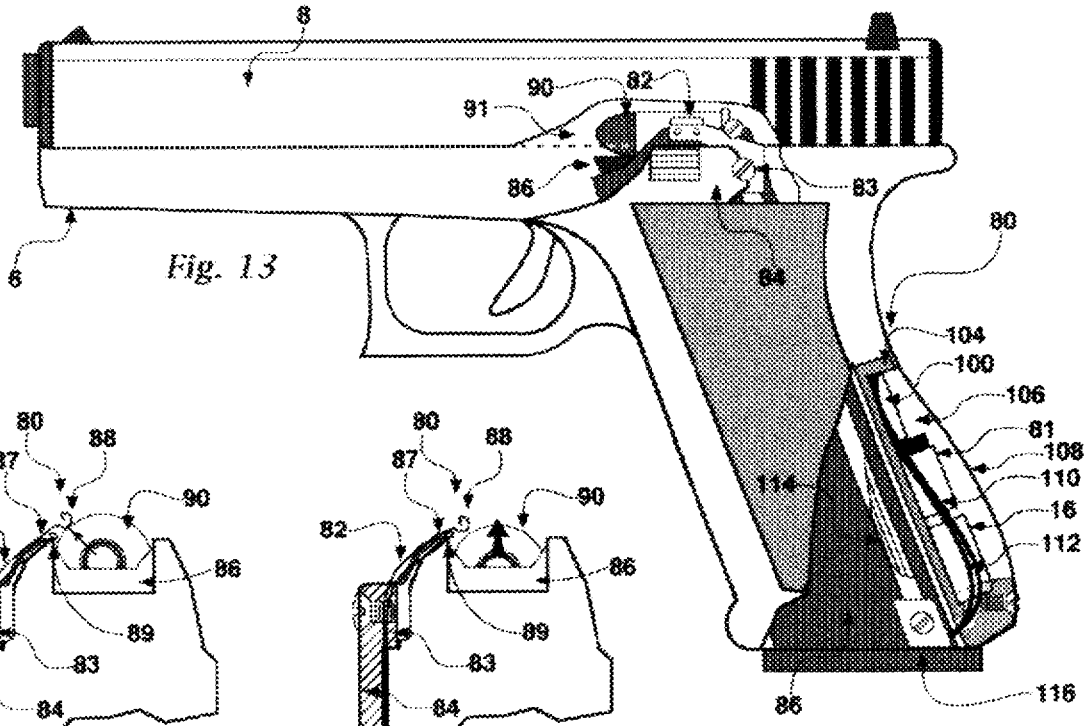
FIG. 13 is a side elevational view, in partial cutaway, illustrating a low ammunition warning assembly installed within a hand gun in accordance with one preferred embodiment of the present invention.
Figure 14A:
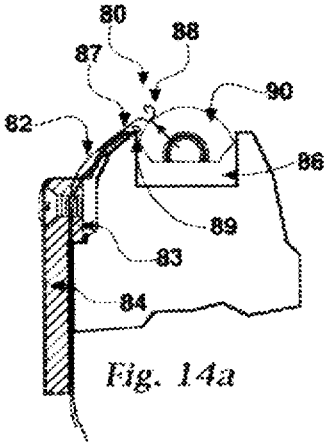
FIG. 14A is an isolated view, in partial section, illustrating an ammo count switch for use with the embodiment of FIG. 13, shown in an open position.
Figure 14B:
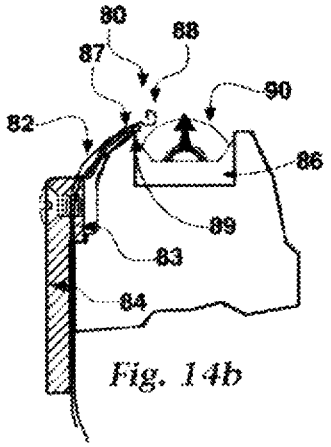
FIG. 14B is an isolated view, in partial section, illustrating the ammo count switch in a closed position.

Referring initially to FIGS. 13–14B, a first preferred embodiment of the low ammunition warning assembly 80 is shown, comprising a vibratory system 81 to indicate a low ammunition condition. The assembly, as seen in FIG. 13, includes an ammo count switch 82 having a base plate 83 mounted to the internal structure 84 of the gun 6, adjacent the magazine 86. An electrical contact 87 includes a spring biased prong member 88 which extends into the path of ammunition exiting the top of the magazine 86 and into the firing chamber 91 of the gun. The spring biased prong element 88 is normally engaged with the uppermost round 90 of ammunition in the magazine 86, urging the prong member 88 away from contact with an electrical contact element 89 in a normally open position, as seen in FIG. 14A. As the uppermost round 90 of ammunition in the magazine is released into the firing chamber 91, the prong element 88 moves down into contact with an electric contact element 89 of the switch 82 to a closed position. This completes a circuit and sends a signal to an electronic circuit device 100 held on a base frame 104 in an internal cavity 106 of a gun handle 108. In the instance there is remaining ammunition in the magazine 86, the next succeeding round moves upwardly to urge the prong member 88 to the open position. This momentarily closed switch condition is measured against a specific predetermined time interval, so that the electronic circuit device 100 can verify that there is rounds of ammunition remaining in the magazine. As the last round of ammunition exits the magazine 86 and into the firing chamber 91 of the gun, the prong element 88 moves down into contact with the electric contact element 89, thus closing the switch 82. With no remaining ammunition to urge the prong 88 to the open position, the switch 82 remains closed on the predetermined time interval. The electronic circuit 100 thereby determines that there is no ammunition remaining in the magazine 86, and activates a vibrating motor 110 on the base frame 104 in the handle 108 of the weapon. A battery 16, also mounted on the base frame 104, provides power to the electric circuit 100, the vibrating motor 110 and switch 82 via electrical conductors 112 and a flat cable 114 which extends from a fastening plate 116 at the lower, butt end of the handle 108 to the switch base plate 83, for interconnection with the ammo count switch 82 assembly.

Figure 15:
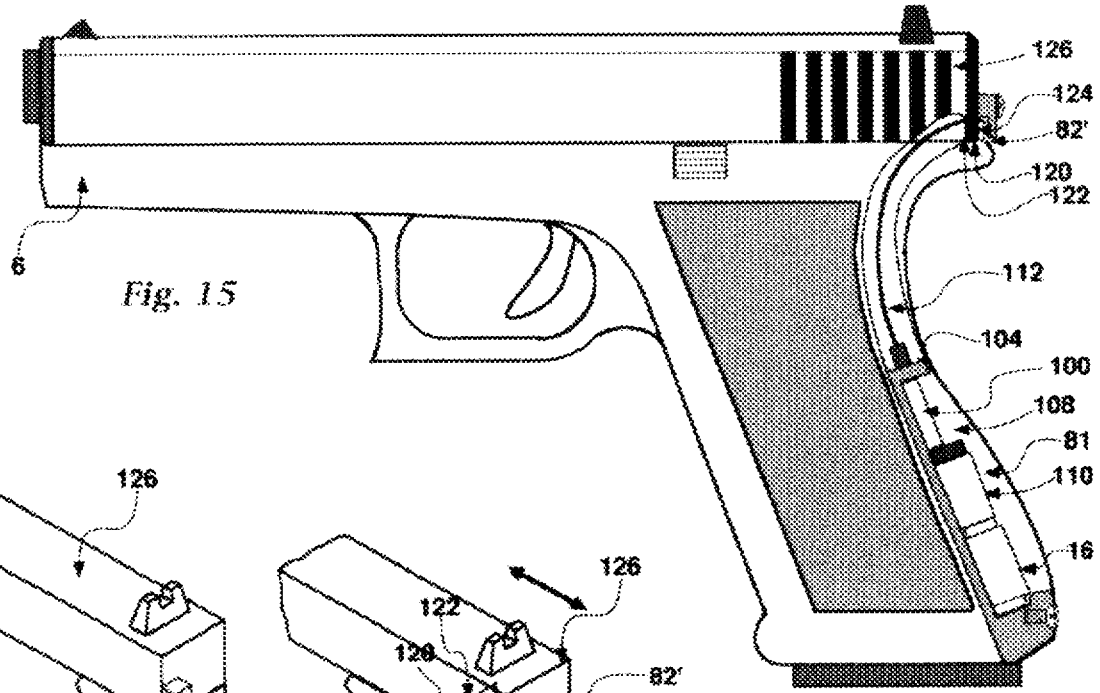
FIG. 15 is a side elevational view illustrating a low ammunition warning system installed in a hand gun in accordance with another preferred embodiment of the present invention.
Figure 16A:
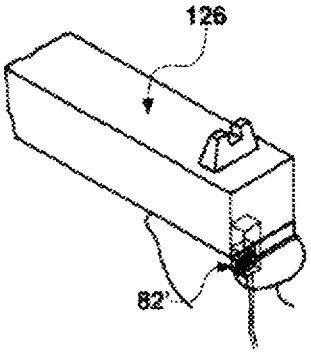
FIG. 16A is an isolated perspective view illustrating a contact count switch assembly in a closed position for use in the embodiment of FIG. 15.
Figure 16B:
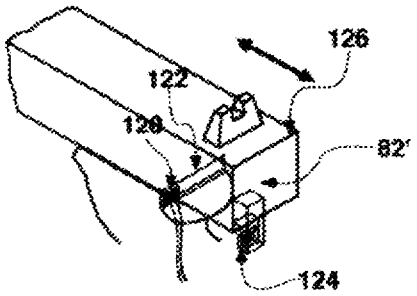
FIG. 16B is an isolated perspective view illustrating the contact count switch assembly in an open position.

An alternative embodiment of the ammo count switch 82' assembly is shown in FIGS. 15–16B. The ammo count switch 82' of this embodiment comprises an array of contact terminals 120 positioned along the rear fixed structure 122 of the hand gun 6 and corresponding bridge contactors 124 fitted to the moving rack structure 126 of the gun 6. The bridge contactors 124 are specifically structured and positioned for mating engagement with corresponding contacts 120 on the fixed structure of the weapon when the rack structure 126 is in the normally relaxed, forward position. Upon pulling or retracting the rack 126 in a rearward direction, or when the weapon is fired to dispense an expended ammo shell from the magazine and cause movement of the next succeeding round of ammunition into the firing chamber, the bridge contactors 124 on the rack structure 126 separate from the array of contacts 120 on the fixed, stationary structure 122, thereby momentarily opening the circuit. The electronic circuit device 100 detects the momentary open circuit condition and thereby determines that a round of ammunition has been expended. The electronic circuit device 100, having been pre-programmed with the amount of rounds carried in the magazine 86, is able to simply calculate the amount of remaining rounds by subtracting the number of expended rounds of ammunition from the total number of rounds contained in the magazine when the clip was inserted into the handle of the weapon 6. Upon determining that the rounds of ammunition remaining in the magazine have reached a predetermined amount, the electronic circuit device 100 actuates the vibrating motor 110 in the gun handle 108. The user of the gun will feel the vibration and realize that only the predetermined number of rounds of ammunition remain.

Figure 17:
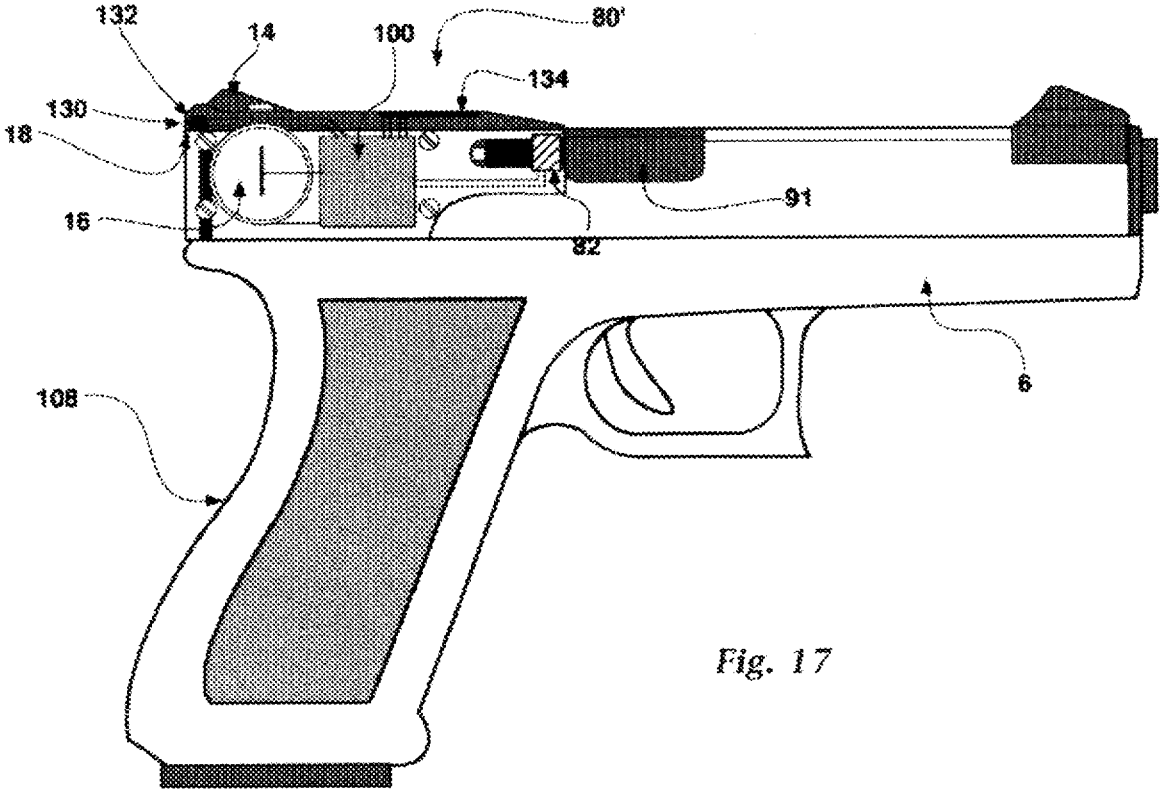
FIG. 17 is a side elevational view illustrating the component elements of a low ammo warning system in accordance with another preferred embodiment of the present invention including a visible warning lamp indicator to indicate a low ammo condition.

Another preferred embodiment of the low ammunition warning assembly 80' is shown in FIG. 17. This particular embodiment is directed to a visible low ammunition warning indicator 130 comprising a light emitting source 132 positioned at the rear end of the weapon, preferably below the rear sight assembly 14. The visible low ammo warning indicator 130 may employ the various light transmitting means, diffusion means, and masking means as described above in connection with the front and rear sight assemblies. The embodiment of FIG. 17 shows an ammo count switch 82 which may be generally of the type described previously in reference to FIGS. 14A and 14B. In this particular embodiment, however, all of the components are housed in the upper portion of the weapon 6, rearward of the firing chamber 91. As described previously, the electronic circuit device 100 tracks the number of rounds of ammunition expended, as detected by the ammo count switch 82, and upon reaching a predetermined low ammunition count, the circuit device 100 actuates the light emitting source 18 to provide visual indication of the low ammo condition. A battery 16, such as that shown in FIG. 17, is contained in the upper portion of the gun to supply power to the electronic circuit device 100, the light emitting source 18, and the ammo count switch 82. Controls 134 on the top of the gun can be provided in order to program the electronic circuit device and to activate and deactivate the visual low ammo warning system 130. Items that can be programmed include the number of rounds of ammunition carried in the magazine as well as the predetermined low ammunition count at which the user desires to be warned or alerted.

Figure 18:
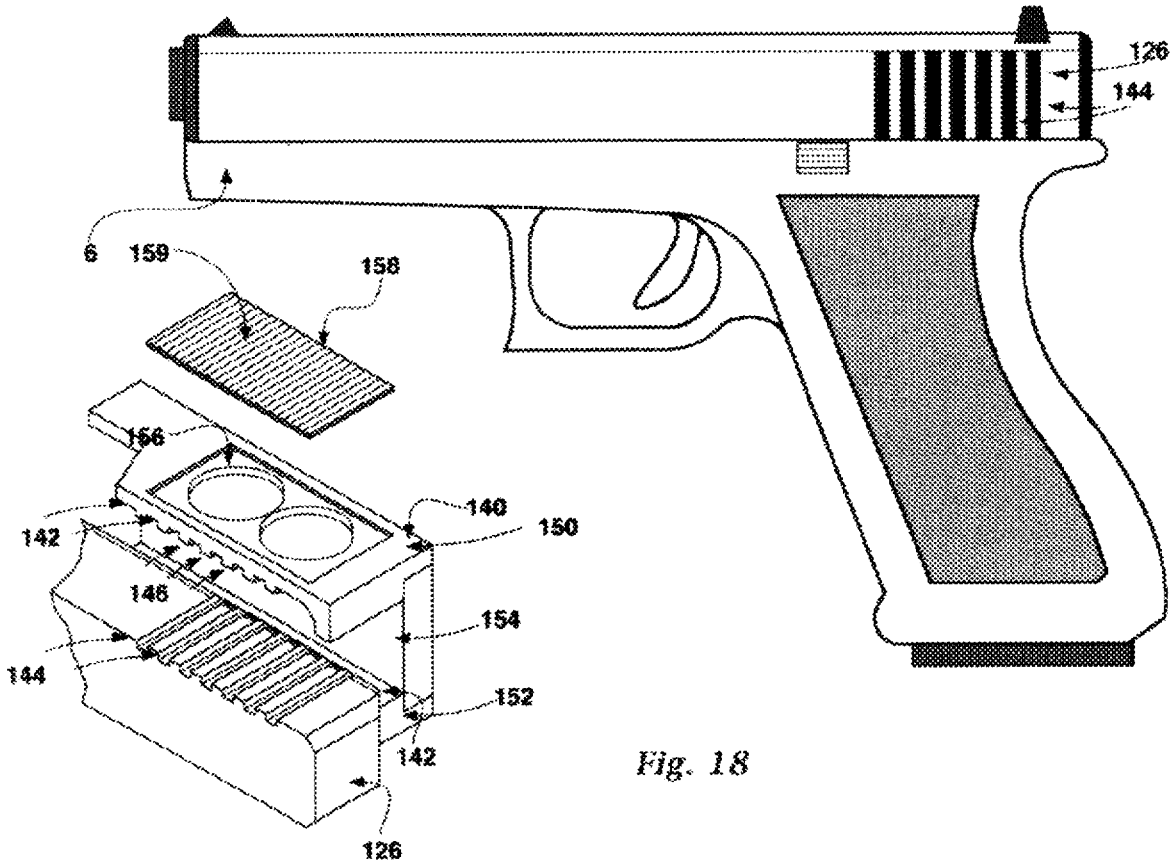
FIG. 18 is an exploded view, shown in perspective, illustrating an external housing for containing component elements of the illuminated gun sight and/or low ammo warning assembly components therein and being structured for fixed attachment to the external structure of a hand gun having means to engage to the racking structure of a pistol and providing a racking grip structure on the exterior of the housing.

The components of the low ammunition warning system 80, including the vibratory indicator system 81 and/or the visual indicator system 130, can be housed in an external housing 140 of the type shown in FIG. 18. This external housing 140 can also accommodate the component elements of the illuminated gun sight assembly 10. The housing 140 is specifically structured to mount on the rear portion of the racking structure 126 of the gun, as illustrated in FIG. 18. The inner side surfaces 142 of the housing 140 are specifically structured for confronting engagement with the external surface 144 of the weapons racking structure 126 and may include teeth 146 or other friction engagement means thereon to fixedly engage the external, congruent configuration 148 on the racking structure 126. In this manner, the housing 140 will not pull free from the racking structure 126 when operating the weapon. The sides 150, 152 and top 154 of the housing are provided with compartments 156 to contain the various components of the illuminated gun sight assembly 10 and/or low ammunition warning assemblies 81, 130. FIG. 18 illustrates a side compartment 156 on the housing 140 which is structured to contain batteries or other circuitry therein. A cover plate 158 fits over the compartment and is provided with a textured outer surface 159 or other means thereon to facilitate grasping so that the user can retract the racking structure 126 to operate the weapon by grasping the side plates 158 of the housing.

Figure 19:
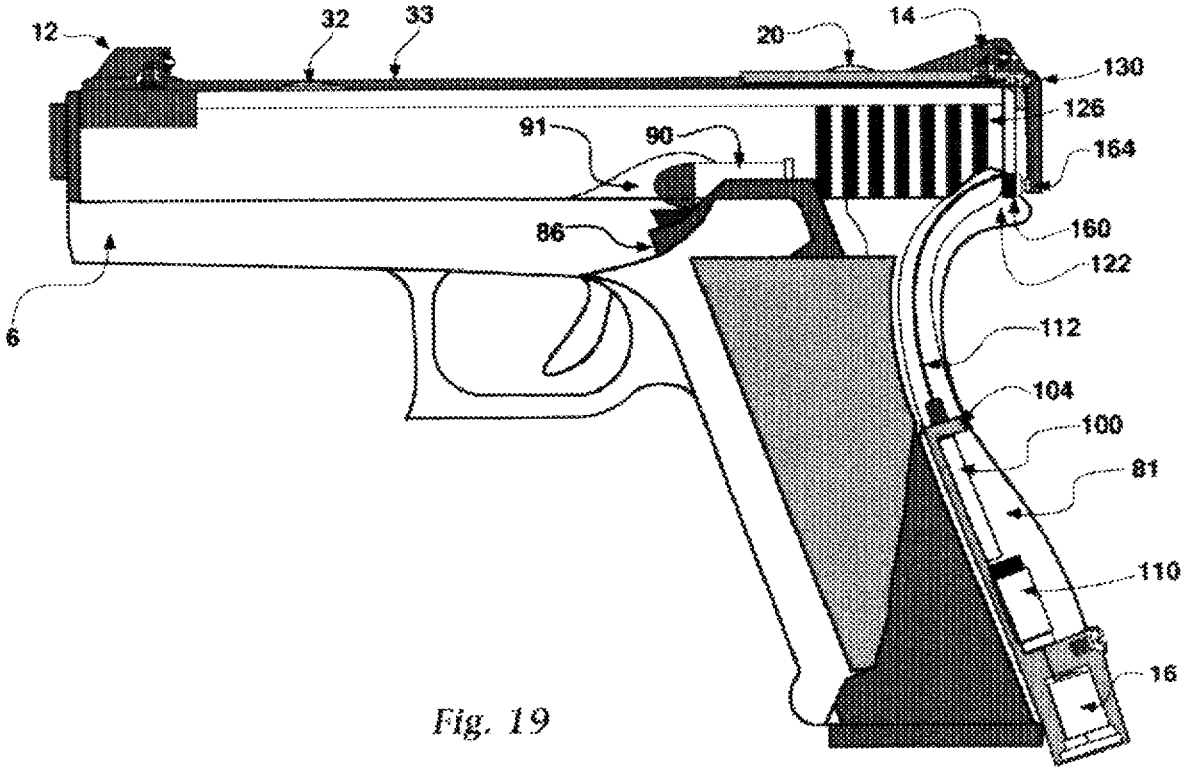
FIG. 19 is a side elevational view, in partial cutaway, illustrating the illuminated gun sight assembly combined with both a vibrating and visible low ammunition warning assembly installed in a hand gun in accordance with one preferred embodiment of the present invention.

Referring to FIG. 19, another embodiment of the present invention is shown wherein the illuminated gun sight assembly 10 and both the vibrating 81 and visible 130 low ammunition warning assemblies are combined in one weapon 6. A battery 16 held in the base frame 104 at the butt end of the handle 108 provides power to the vibrating motor 110, electronic circuitry 100, and the light sources 18 for the front sight assembly 12, the rear sight assembly 14, and the visible low ammo warning indicator 132. A contact switch assembly 82", similar to that of the type shown in FIGS. 16A and 16B, is provided at the rear of the racking structure 126.

Figure 20B:
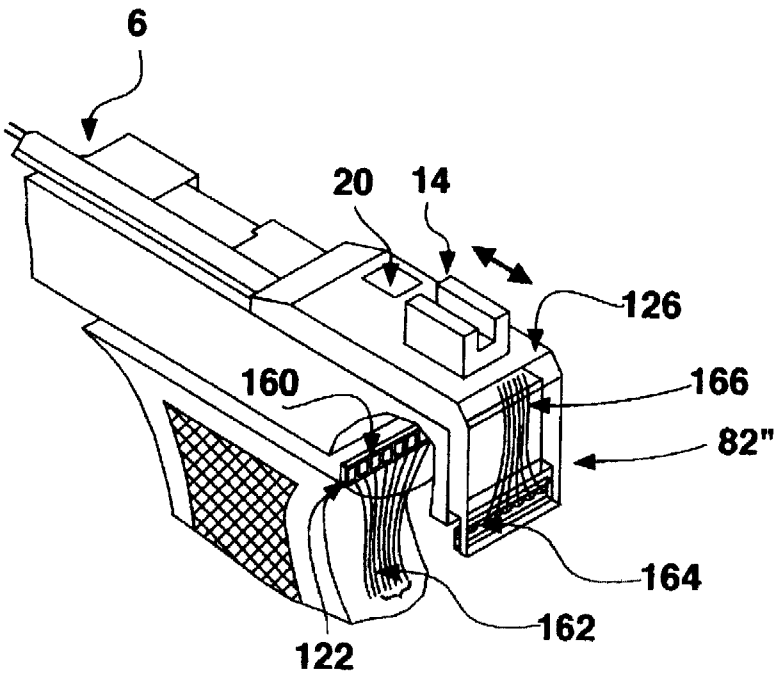
FIG. 20B is an isolated perspective view of the switch contact system shown in an open circuit condition.
Figure 20A:
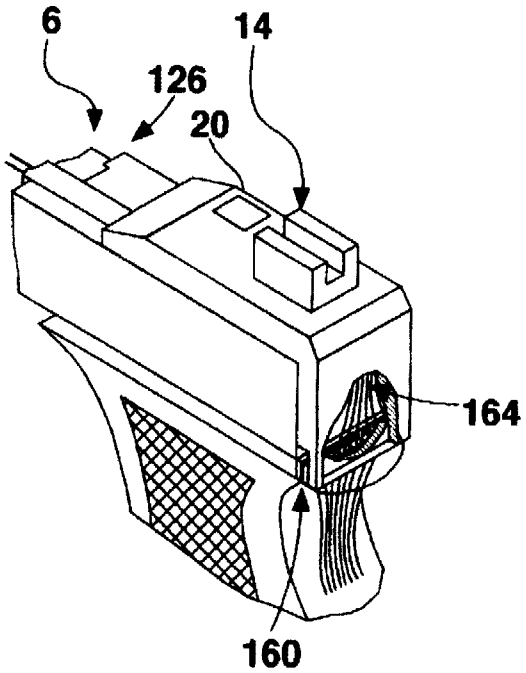
FIG. 20A is a isolated perspective view of an electrical contact system, shown in a closed circuit position, on the rear racking assembly of a hand gun for use in connection with the embodiment of FIG. 19.

A detail of the contact switch assembly 82" is shown in FIGS. 20A and 20B. An arrangement of contact elements 160 are provided on the stationary structure 122 of the weapon, adjacent the rear end of the racking structure 126. Each of the contacts 160 are individually interconnected via terminals 162 to the battery power source 16, the vibrating motor 110, and the electronic circuit device 100. An opposing array of contacts 164 are provided on the rear end of the racking structure 126 for electrical contact with corresponding ones of the contacts 160 on the fixed structure of the gun. Each of the contacts on the array 164 are interconnected with terminals 166 which lead to the various electrically operated components on the upper portion of the gun including the light sources 18 for the sight assemblies 12, 14, and visual low ammo indicator 132 as well as the servo system sensor 20. Similar to the embodiment described above, in connection with FIGS. 16A and 16B, a low ammo count switch can be incorporated in the contact switch assembly 82" to detect movement of the racking structure 126 after each round of ammunition is fired. By tracking the cycles of movement of the racking structure, the electronic circuit device 100 is able to determine the amount of ammunition remaining in the magazine. Upon reaching the predetermined low ammo count, both the vibrating motor 110 and visual low ammo indicator lamp 132 are activated when the contacts 164 on the racking structure are disposed in electrical contact with the corresponding contacts 160 on the fixed structure 122 of the weapon.

Figure 21:
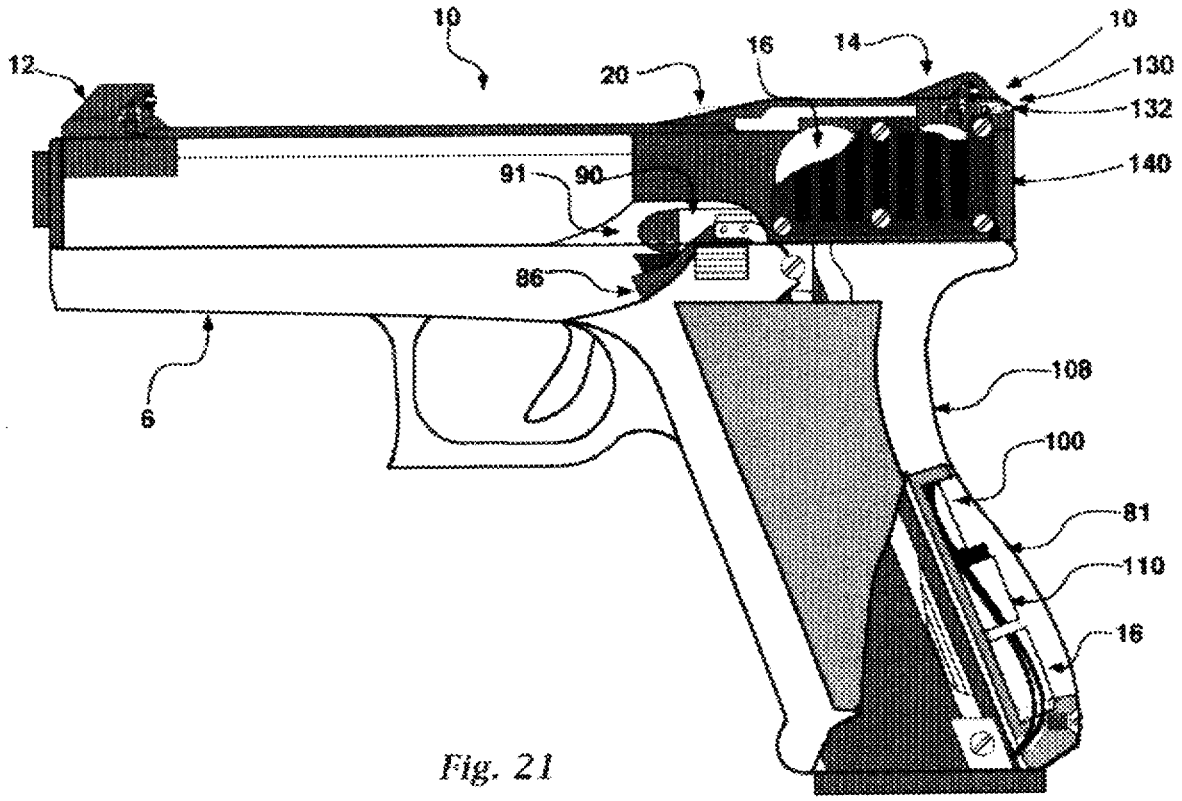
FIG. 21 is a side elevational view, in partial cutaway, illustrating the illuminated gun sight assembly combined with both a vibrating and visible low ammunition warning assembly installed in a hand gun in accordance with another preferred embodiment of the present invention.

FIG. 21 illustrates yet another preferred embodiment of the present invention wherein the illuminated gun sight assembly 10 is combined with both the vibrating 81 and visible 130 low ammunition warning assemblies. FIG. 21 shows the use of independent electronic circuit devices 100, 100' in both the handle portion 108 and an upper housing 140 mounted to the upper portion of the gun for independent operation of components on the weapon. Specifically, the electronic circuit device 100 in the handle controls actuation of the vibrating motor 110 upon detection of a low ammo count as tracked by the ammo count switch device 82 on the top of the magazine 86.

The separate electronic circuit device 100' within the housing 140 on the upper portion of the gun, as shown in FIG. 21, controls operation of the front 12 and rear 14 sight assemblies as well as the visual low ammo indicator lamp 132. A housing 140 generally of the type described and illustrated in connection with the embodiment of FIG. 18 can be used to house the various components of the illuminated gun sight assembly 10 (with the exception of the front sight assembly), the visual low ammo indicator assembly 130, and on/off and programming controls 134.

Figures 22, 23:
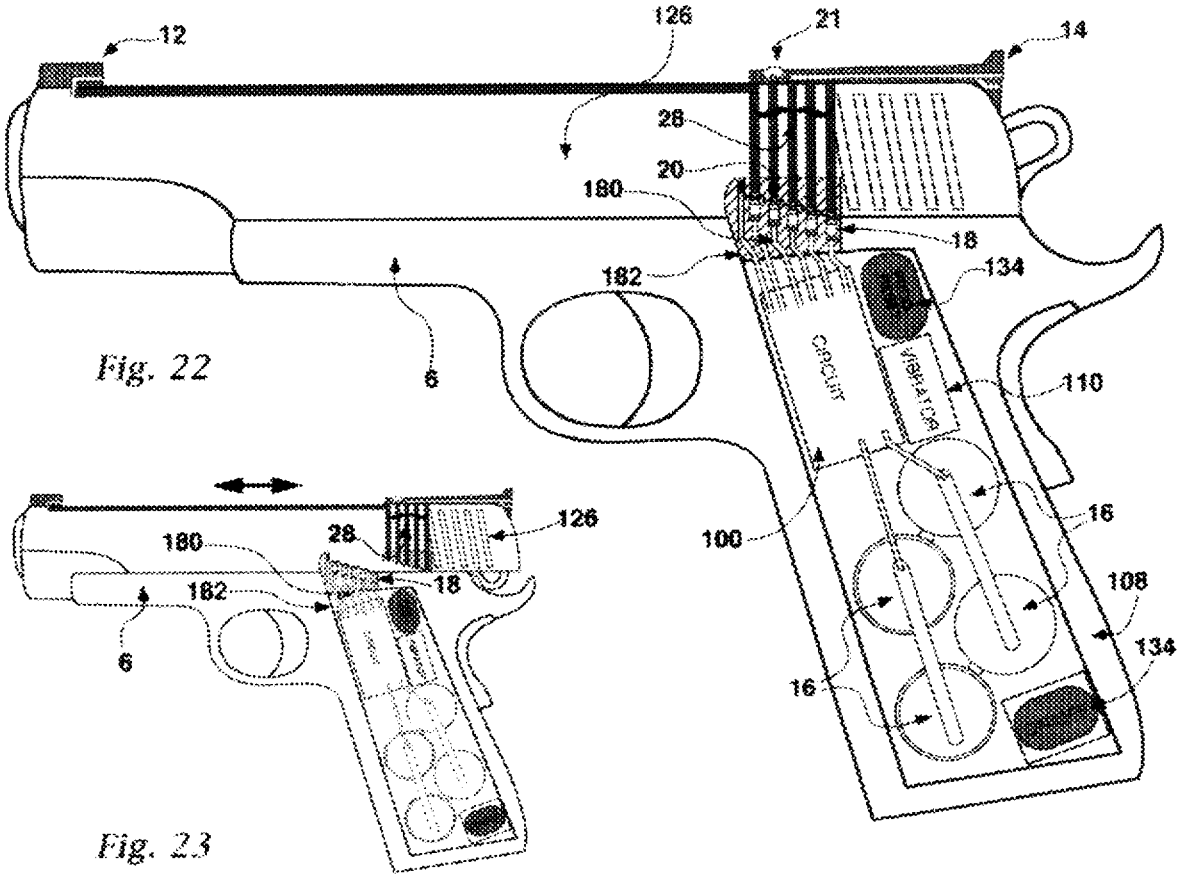
FIG. 22 is a side elevational view, in partial cutaway, illustrating the illuminated gun sight assembly combined with both the vibrating and visible low ammunition warning assembly installed in a hand gun in accordance with yet another preferred embodiment of the present invention.
FIG. 23 is a side elevational view, in partial cutaway, of the embodiment of FIG. 22, showing a racking structure of the weapon in a retracted position.

Referring to FIGS. 22 and 23, another embodiment of the invention is shown wherein a plurality of individual light sources 18 are maintained in a fixed array 180 on the stationary portion 182 of the weapon 6, adjacent the racking structure 126. Corresponding fiber optic guides 28 or strands are arranged so that one end of each of the fiber optic guides 28 aligns with a corresponding light source 18 when the racking structure 126 is in the normal, relaxed position. Each of the fiber optic guides extend to a visual indicator means including the front sight assembly 12, the rear sight assembly 14, and the visible low ammo indicator 130 for transmitting light from the individual light sources 18 to the various visual elements. A fiber optic or like light transmitting element 28 may further be used to transmit light gathered by a lens 21 to the servo system sensor 20 on the fixed array 180. The sensor 20, along with the various independent light sources 18 on the fixed array 180, each interconnect to the electronic circuit device 100.

The embodiment of FIG. 22 may further include the vibrating low ammunition warning system 81 including the vibrating motor 110 housed within the handle 108 of the weapon 6. The plurality of batteries 16 contained within the handle provide power to the circuit device 100, vibrating motor 110 and light emitting sources 18. Controls 134 such as on/off actuators, programming controls and reset controls may be further provided.

While the instant invention has been described and illustrated in what is considered to be preferred and practical embodiments thereof, it is recognized that departures may be made within the spirit and scope of the present invention which, therefore, should not be limited except as set forth in the following claims and within the doctrine of equivalents.

Now that the invention has been described,

What is claimed is:

1. An assembly for use on a weapon of the type adapted to contain and discharge a load of ammunition and having a central longitudinal axis extending from a proximal and zone, including a proximal end, to a distal end zone, and a barrel extending along the central axis between the proximal and zone and distal end zone, said assembly comprising:

a front sight on said distal end zone, a rear sight on said proximal end zone, light emitting means an said front and rear sights for radiating light in a direction towards said proximal end in substantially parallel relation to said central longitudinal axis, light generating means for providing light to said light emitting means upon application of electric current thereto, modifying means for producing substantially uniform light intensity throughout the visible light radiating area at said light emitting means, means for adjusting the position of at least one of said front and rear sights comprising detachable aperture means wherein said aperture is of predetermined size and shape to permit passage from said light emitting means therethrough to produce a distinct luminous reference shape, Light adjusting means responsive to ambient light conditions for adjusting the intensity of light radiating from said light emmiting means, so that the light intensity of visible light radiating from said light emmiting means increases as the intensity of the ambient light condition Increases and, alternatively, so that the light intensity of the visible light radiating from said light emitting means decreases as the intensity of the ambient light condition decreases, a low ammunition warning system comprising:

tracking means for tracking depletion of ammunition from said load of ammunition, detecting means for detecting depletion of ammunition from said load of ammunition, and signal means responsive to said tracking means upon ammunition remaining in said load reaching a predetermined low amount for indicating a low ammunition status.

2. An assembly as recited in claim 1 wherein said light emitting means on said front sight includes a single light emitting element positioned so as to radiate light in parallel, vertically aligned relation to said central longitudinal axis along a center line of sight on a top of the weapon.

3. An assembly as recited in claim 2 wherein said light emitting means on said rear sight includes a pair of spaced, light emitting elements positioned so as to radiate light in parallel relation to said longitudinal axis on opposite sides of said center line of sight.

4. An assembly as recited in claim 3 wherein said light generating means includes at least one light emitting diode lamp.

5. An assembly as recited in claim 4 wherein said single light emitting element on said front sight radiates a first light color and said pair of spaced light emitting elements on said rear sight radiate a second light color.

6. An assembly as recited in claim 5 wherein said first light color is in contrast relative to said second light color.

7. An assembly as recited in claim 3 wherein said light adjusting means includes photosensitive means for absorbing ambient light and controlling electric current flow to said light emitting means to control the intensity of visible light radiating therefrom.

8. An assembly as recited in claim 3 wherein said modifying means comprises light diffusion means for producing said uniform light intensity throughout said light radiating area.

9. An assembly as recited in claim 3 wherein said modifying means comprises light collimating means.

10. An assembly as recited in claim 9 wherein said light collimating means includes at least one fiber optic strand extending between said light generating means and said light emitting means.

11. An assembly as recited in claim 3 wherein said modifying means comprises at least one lens element.

12. An assembly as recited in claim 3 wherein said aperture means comprises a mask attachable in covering relation to said light emitting means and includes an aperture of predetermined size and shape to permit passage from said light emitting means therethrough to produce a distinct luminous reference shape.

13. An assembly in claim 12 wherein said apertured element is adjustable to said light emitting means so as to selectively position said aperture.

14. An assembly as recited in claim 3 wherein said signal means includes a visible indicator lamp.

15. An assembly as recited in claim 3 wherein said signal means includes a vibrating device mounted within the weapon and structured to produce a vibration upon activation which can be felt when holding the weapon.

16. An assembly as recited in claim 3 further including means for providing electric current to said light generating means, said ammo detecting means, said signal means and said light adjusting means.

17. An assembly as recited in claim 17 wherein said means for providing electric current includes power conservation means.

18. An assembly for use on a weapon of the type having a central longitudinal axis extending from a proximal and zone, including a proximal end, to a distal end zone, and a barrel extending along the central axis between the proximal and zone and distal end zone, said assembly comprising:

a front sight on said distal end zone, a rear sight on said proximal end zone, light emitting means an said front and rear sights for radiating light in a direction towards said proximal end in substantially parallel relation to said central longitudinal axis, light generating means for providing light to said light emitting means upon application of electric current thereto, modifying means for producing substantially uniform light intensity through out the visible light radiating area at said light emmiting means, means for adjusting the position of at least one of said front and rear sights comprising detachable aperture means wherein said aperture is of predetermined size and shape to permit passage from said light emitting means therethrough to produce a distinct luminous reference shape, Light adjusting means responsive to ambient light conditions for adjusting the intensity of light radiating from said light emmiting means, so that the light intensity of visible light radiating from said light emmiting means increases as the intensity of the ambient light condition increases and, alternatively, so that the light intensity of the visible light radiating from said light emitting means decreases as the intensity of the ambient light condition decreases.

19. An assembly as recited in claim 18 wherein said light emitting means on said front sight includes a single light emitting element positioned so as to radiate light in parallel, vertically aligned relation to said central longitudinal axis along a center line of sight on a top of the weapon.

20. An assembly as recited in claim 19 wherein said light emitting means on said rear sight includes a pair of spaced, light emitting elements positioned so as to radiate light in parallel relation to said longitudinal axis on opposite sides of said center line of sight.

21. An assembly as recited in claim 20 wherein said light generating means includes at least one light emitting diode lamp.

22. An assembly as recited in claim 21 wherein said single light emitting element on said front sight radiates a first light color and said pair of spaced light emitting elements on said rear sight radiate a second light color.

23. An assembly as recited in claim 22 wherein said first light color is in contrast relative to said second light color.

24. An assembly as recited in claim 20 wherein said light adjusting means includes photosensitive means for absorbing ambient light and controlling electric current flow to said light emitting means to control the intensity of visible light radiating therefrom.

25. An assembly as recited in claim 20 wherein said modifying means comprises light diffusion means for producing said uniform light intensity throughout said light radiating area.

26. An assembly as recited in claim 20 wherein said modifying means comprises light collimating means.

27. An assembly as recited in claim 26 wherein said light collimating means includes at least one fiber optic strand extending between said light generating means and said light emitting means.

28. An assembly as recited in claim 20 wherein said modifying means comprises at least one lens element.

29. An assembly as recited in claim 20 wherein said modifying means comprises a mask attachable in covering relation to said light emitting means and includes an aperture of predetermined size and shape to permit passage from said light emitting means therethrough to produce said distinct luminous reference shape of uniform light intensity throughout said visible light radiating area.

30. An assembly as recited in claim 29 wherein said mask is adjustable relative to said light emitting means so as to selectively position said aperture.

31. An assembly for use on a weapon of the type including a handle and a barrel and adapted to contain and discharge a load of ammunition, said assembly comprising:

a low ammunition warning system including:

tracking means for tracking depletion of ammunition from said load of ammunition, detecting means for detecting depletion of ammunition from said load of ammunition, and signal means responsive to said tracking means upon ammunition remaining in said load reaching a predetermined low amount for indicating a low ammunition status, said signal means further including vibrating means including a vibrating motor contained within the handle of the weapon, said vibrating motor being actuated by said tracking means to cause the handle of the weapon to vibrate.

32. An assembly as recited in claim 31 wherein said visible indicator includes light emitting means on a rearward facing portion of the weapon for radiating light in a direction towards the user when aiming the weapon towards a target.

33. An assembly as recited in claim 32 wherein said visible indicator further includes light generating means for providing light to said light emitting means.

34. An assembly as recited in claim 33 wherein said light generating means includes at least one light emitting diode lamp.

35. An assembly as recited in claim 34 further including light transmitting means for transmitting light from said light generating means to said light emitting means.

36. An assembly as recited in claim 35 wherein said light transmitting means is a fiber optic element extending between said light generating means and said light emitting means.

37. An assembly for use on a weapon of the type adapted to contain and discharge a load of ammunition and having a central longitudinal axis extending from a proximal and zone, including a proximal end, to a distal end zone, and a barrel extending along the central axis between the proximal and zone and distal end zone, said assembly comprising:

a front sight on said distal end zone, a rear sight on said proximal end zone, light emmiting means an said front and rear sights for radiating light in a direction towards said proximal end in substantially parallel relation to said central longitudinal axis, light generating means for providing light to said light emmiting means upon application of electric current thereto, modifying means for producing substantially uniform light intensity throughout the visible light radiating area at said light emmiting means, light adjusting means responsive to ambient light conditions for adjusting the intensity of light radiating from said light emmiting means, so that the light intensity of visible light radiating from said light emmiting means increases as the intensity of the ambient light condition increases and, alternatively, so that the light intensity of the visible light radiating from said light emmiting means decreases as the intensity of the ambient light condition decreases, a low ammunition warning system comprising:

tracking means for tracking depletion of ammunition from said load of ammunition, detecting means for detecting depletion of ammunition from said load of ammunition, and signal means responsive to said tracking means upon ammunition remaining in said load reaching a predetermined low amount for indicating a low ammunition status, control means on the weapon for programming said tracking means with at least said predetermined low amount.

38. An assembly for use on a weapon of the type including a handle and a barrel and adapted to contain and discharge a load of ammunition, said assembly comprising:

a low ammunition warning system including:

tracking means for tracking discharge of ammunition from said load of ammunition, detecting means for detecting discharge of ammunition from said load of ammunition, and signal means responsive to said tracking means upon ammunition remaining in said load reaching a predetermined low amount for indicating a low ammunition status, control means on the weapon for programming said tracking means with at least said predetermined low amount.

39. An assembly for use on a weapon of the type including a handle, a barrel, a slide movable between a firing position and a retracted position in order to advance a round of ammunition into a firing chamber, and a central longitudinal axis extending from a proximal end zone of the barrel to a distal end zone, said assembly comprising:

a front sight on said distal end zone, a rear sight on said proximal end zone, light emitting means on said front and rear sights for radiating light in a direction towards said proximal end zone in substantially parallel relation to said central longitudinal axis, light generating means for providing light to said light emitting means upon application of electric current thereto, means for transmitting the light from said light generating means to said light emitting means, alignment means for completing transmission of the light from said light generating means to said light emitting means when said slide of said weapon is in the firing position and for interrupting light transmission from said generating means to said light emitting means when said slide is in the retracted position, modifying means for producing substantially uniform light intensity throughout the visible light radiating area at said light emitting means, Light adjusting means responsive to ambient light conditions for adjusting the intensity of light radiating from said light emmiting means, so that the light intensity of visible light radiating from said light emmiting means increases as the intensity or the ambient light condition increases and, alternatively, so that the light intensity of the visible light radiating from said light emitting means decreases as the intensity of the ambient light condition decreases.

40. An assembly as recited in claim 39 wherein said means for transmitting the light from said light generating means to said light emitting means includes light piping means.

41. An assembly as recited in claim 40 wherein said light piping means includes at least one fiber optic strand.

42. An assembly as recited in claim 40 wherein said alignment means includes means for aligning said light piping means with said light generating means when said slide of said weapon is in the firing position, thereby completing transmission of the light to said light emitting means.

43. An assembly as recited in claim 39 wherein said light generating means is powered by an electric power source.

44. An assembly as recited in claim 43 further including conductor means for delivering electric current from said electric power source to said light generating means for actuation thereof.

45. An assembly as recited in claim 44 wherein said alignment means includes electric contact means for completing electric current flow from said electric power source to said light generating means when said slide of said of said weapon is in the firing position, defining a closed contact position.

46. An assembly as recited in claim 45 wherein said electric contact means is further operable to interrupt electric current flow from said electric power source to said light generating means upon movement of said slide of said weapon to said retracted position, defining an open contact position wherein said light generating means is deactivated.

47. An assembly as recited in claim 38 wherein said signal means include visible indicator structured to illuminate upon said ammunition reaching a predetermined low amount.

48. An assembly as recited in claim 47 further including light adjusting means for adjusting the intensity of light radiating from said visible indicator.

49. An assembly as recited in claim 48 wherein said light adjusting means is responsive to ambient light conditions for adjusting the intensity of light radiating from said visible indicator so that the light intensity of visible light radiating from said visible indicator increases as the intensity of the ambient light condition increases and, alternatively, so that the light intensity of the visible light radiating from said visible indicator decreases as the intensity of the ambient light condition decreases.

50. An assembly as recited in claim 38 wherein said signal means include vibrating means structured to vibrate upon said ammunition reaching a predetermined low amount.

51. An assembly as recited in claim 38 wherein said tracking means is structured as to actuate multiple signal means.

52. An assembly as recited in claim 51 wherein each of said multiple signal means can be actuated as to operate independently at different count events.

53. An assembly as recited in claim 38 wherein the count of said initial load of ammunition contained on the weapon can be programmed at the control means on the weapon.

54. An assembly as recited in claim 38 wherein the initial count of said initial load of ammunition contained on the weapon is preprogrammed on the tracking means.

55. An assembly as recited claim 52 wherein at least one of said multiple signal means is preprogrammed on the tracking means.

* * * * *

UNITED STATES PATENT AND TRADEMARK OFFICE

CERTIFICATE OF CORRECTION

PATENT NO. : 5,735,070
APPLICATION NO. : 08/621733
DATED : April 7, 1998
INVENTOR(S) : Eduardo C. Vasquez It is certified that error appears in the above-identified patent and that said Letters Patent is hereby corrected as shown below:

The Title Page, showing an illustrative figure, should be deleted and substitute therefor the attached Title Page.

Signed and Sealed this

Thirtieth Day of June, 2009

John Doll

JOHN DOLL
*Acting Director of the United States Patent and Trademark Office*

United States Patent [19]

Vasquez

[11] Patent Number: 5,735,070

[45] Date of Patent: Apr. 7, 1998

[54] ILLUMINATED GUN SIGHT AND LOW AMMUNITION WARNING ASSEMBLY FOR FIREARMS

[76] Inventors: Eduardo C. Vasquez, P.O. Box 145187, Coral Gables FL 33134

[21] Appl. No.: 621,733

[22] Filed: Mar. 21, 1996

[51] Int. Cl.[6] ..... F41A 9/62; F41G 1/34

[52] U.S. Cl. ..... 42/1.02; 42/103; 33/241

[58] Field of Search ..... 42/1.01, 1.02, 42/103; 33/241

[56] References Cited

U.S. PATENT DOCUMENTS

| | | | |
|---|---|---|---|
| 3,698,092 | 10/1972 | Rosenhan | 33/241 |
| 3,833,799 | 9/1974 | Audet | 42/1.02 |
| 3,914,873 | 10/1975 | Elliott, Jr. et al. | 33/241 |
| 4,219,953 | 9/1980 | Musgrave | 42/1.02 |
| 4,434,560 | 3/1984 | Comeyne | 33/241 |
| 5,142,805 | 9/1992 | Horne et al. | 42/102 |

*Primary Examiner*—J. Woodrow Eldred

[57] ABSTRACT

An assembly for use on weapons includes an illuminated gun sight system to permit the user to aim and shoot the weapon in varying ambient light conditions and including a first light emitting element on a front sight and a second pair of light emitting elements on a rear sight of the firearm, a light generating source to provide light to the first light emitting element and the second pair of light emitting elements; the first and second light emitting elements including a light modifying element to produce a distinct luminous reference shape of uniform light intensity throughout a visible light radiating area. A servo system sensor is responsive to ambient light conditions for adjusting the intensity of light radiating from the light emitting elements so that the intensity of light radiating from the light emitting elements increases and decreases in direct relation to changes in ambient light conditions. A low ammunition warning system includes a detector and a circuit for tracking depletion of ammunition contained in the weapon. Visible and tactile signals, responsive to the circuit, warn the user when a known pre-set low ammunition count has been reached.

55 Claims, 12 Drawing Sheets

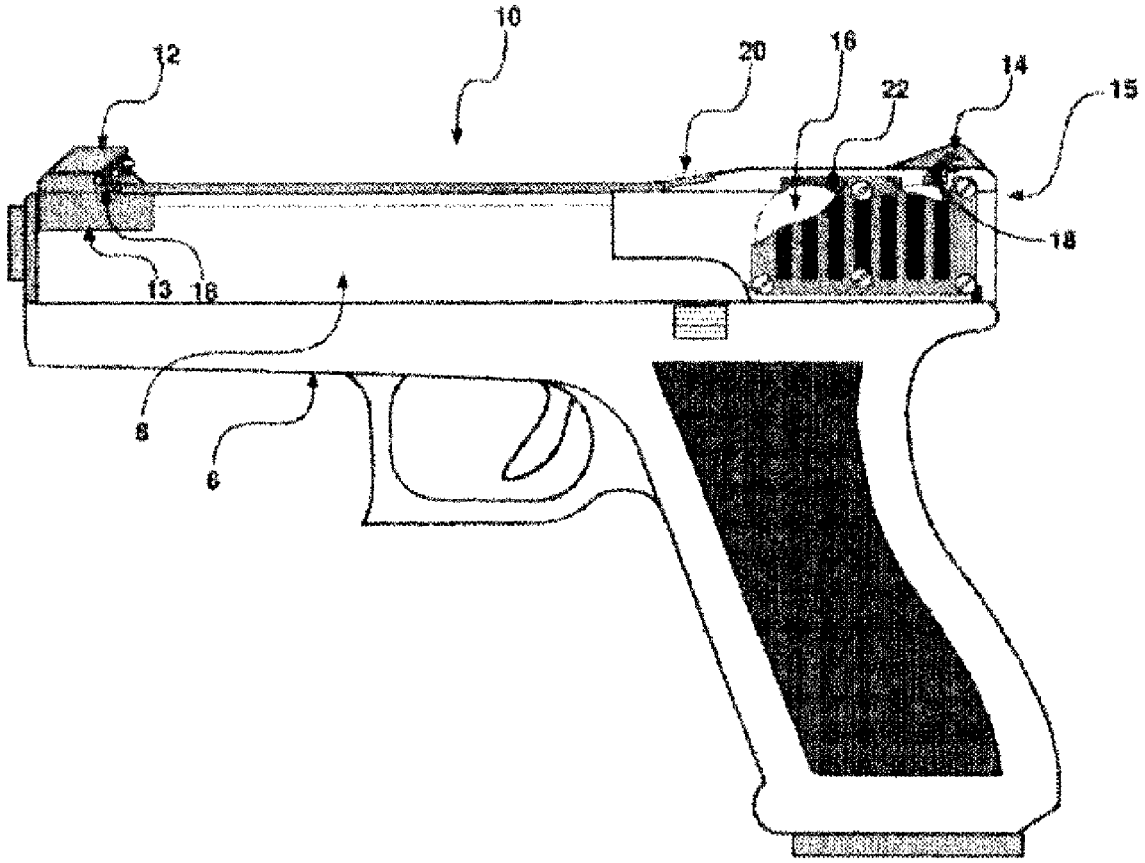

UNITED STATES PATENT AND TRADEMARK OFFICE

CERTIFICATE OF CORRECTION

PATENT NO. : 5,735,070
APPLICATION NO. : 08/621733
DATED : April 7, 1998
INVENTOR(S) : Eduardo C. Vasquez It is certified that error appears in the above-identified patent and that said Letters Patent is hereby corrected as shown below:

The Title Page, showing an illustrative figure, should be deleted and substitute therefor the attached Title Page.

This certificate supersedes the Certificate of Correction issued June 30, 2009.

Signed and Sealed this

Fourth Day of August, 2009

John Doll

JOHN DOLL
*Acting Director of the United States Patent and Trademark Office*

United States Patent [19]

Vasquez

[11] Patent Number: 5,735,070

[45] Date of Patent: Apr. 7, 1998

[54] ILLUMINATED GUN SIGHT AND LOW AMMUNITION WARNING ASSEMBLY FOR FIREARMS

[76] Inventors: Eduardo C. Vasquez, P.O. Box 145187, Coral Gables FL 33134

[21] Appl. No.: 621,733

[22] Filed: Mar. 21, 1996

[51] Int. Cl.[6] ..... F41A 9/62; F41G 1/34

[52] U.S. Cl. ..... 42/1.02; 42/103; 33/241

[58] Field of Search ..... 42/1.01, 1.02, 42/103; 33/241

[56] References Cited

U.S. PATENT DOCUMENTS

| | | | |
|---|---|---|---|
| 3,698,092 | 10/1972 | Rosenhan | 33/241 |
| 3,833,799 | 9/1974 | Audet | 42/1.02 |
| 3,914,873 | 10/1975 | Elliott, Jr. et al. | 33/241 |
| 4,219,953 | 9/1980 | Musgrave | 42/1.02 |
| 4,434,560 | 3/1984 | Comeyne | 33/241 |
| 5,142,805 | 9/1992 | Horne et al. | 42/102 |

*Primary Examiner*—J. Woodrow Eldred

[57] ABSTRACT

An assembly for use on weapons includes an illuminated gun sight system to permit the user to aim and shoot the weapon in varying ambient light conditions and including a first light emitting element on a front sight and a second pair of light emitting elements on a rear sight of the firearm, a light generating source to provide light to the first light emitting element and the second pair of light emitting elements; the first and second light emitting elements including a light modifying element to produce a distinct luminous reference shape of uniform light intensity throughout a visible light radiating area. A servo system sensor is responsive to ambient light conditions for adjusting the intensity of light radiating from the light emitting elements so that the intensity of light radiating from the light emitting elements increases and decreases in direct relation to changes in ambient light conditions. A low ammunition warning system includes a detector and a circuit for tracking depletion of ammunition contained in the weapon. Visible and tactile signals, responsive to the circuit, warn the user when a known pre-set low ammunition count has been reached.

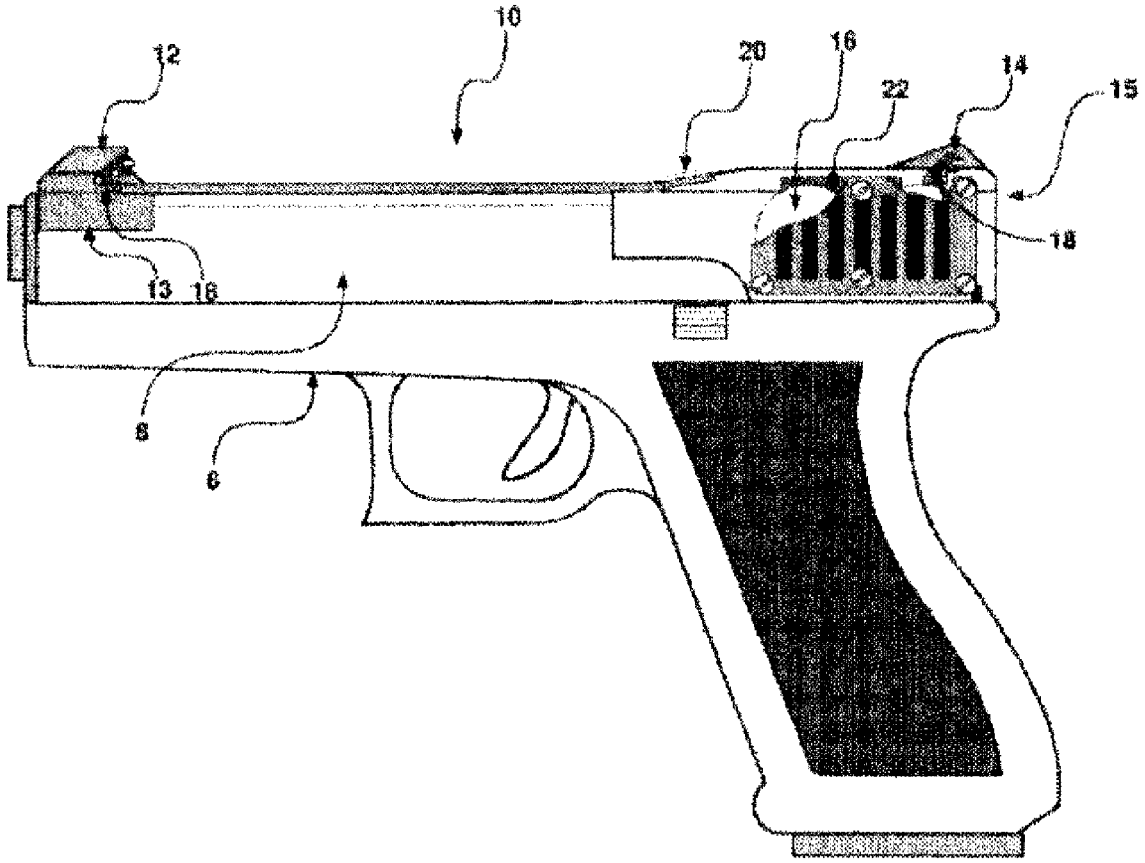

55 Claims, 12 Drawing Sheets